US008214221B2

(12) United States Patent
Pang et al.

(10) Patent No.: US 8,214,221 B2
(45) Date of Patent: Jul. 3, 2012

(54) METHOD AND APPARATUS FOR DECODING AN AUDIO SIGNAL AND IDENTIFYING INFORMATION INCLUDED IN THE AUDIO SIGNAL

(75) Inventors: Hee Suk Pang, Seoul (KR); Hyen-O Oh, Gyeonggi-do (KR); Dong Soo Kim, Seoul (KR); Jae Hyun Lim, Seoul (KR); Yang-Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 996 days.

(21) Appl. No.: 11/994,407

(22) PCT Filed: Jun. 30, 2006

(86) PCT No.: PCT/KR2006/002583

§ 371 (c)(1),
(2), (4) Date: Jun. 9, 2008

(87) PCT Pub. No.: WO2007/004833

PCT Pub. Date: Jan. 11, 2007

(65) Prior Publication Data

US 2009/0216543 A1 Aug. 27, 2009

Related U.S. Application Data

(60) Provisional application No. 60/803,825, filed on Jun. 2, 2006, provisional application No. 60/792,329, filed on Apr. 17, 2006, provisional application No. 60/786,740, filed on Mar. 29, 2006, provisional application No. 60/735,628, filed on Nov. 12, 2005, provisional application No. 60/729,225, filed on Oct. 24, 2005, provisional application No. 60/726,228, filed on Oct. 14, 2005, provisional application No. 60/723,007, filed on Oct. 4, 2005, provisional application No. 60/719,202, filed on Sep. 22, 2005, provisional application No. 60/712,119, filed on Aug. 30, 2005, provisional application No. 60/695,007, filed on Jun. 30, 2005.

(30) Foreign Application Priority Data

Jan. 13, 2006 (KR) ..... 10-2006-0004055
Jan. 13, 2006 (KR) ..... 10-2006-0004056
Jan. 13, 2006 (KR) ..... 10-2006-0004065
Jun. 22, 2006 (KR) ..... 10-2006-0056480

(51) Int. Cl.
*G10L 19/00* (2006.01)

(52) U.S. Cl. ..... 704/500

(58) Field of Classification Search ..... 704/206, 704/500–504
See application file for complete search history.

(56) References Cited

U.S. PATENT DOCUMENTS 4,621,862 A 11/1986 Kramer
(Continued)

FOREIGN PATENT DOCUMENTS

CA 2554002 A1 7/2005
(Continued)

OTHER PUBLICATIONS

"Text of second working draft for MPEG Surround", ISO/IEC JTC 1/SC 29/WG 11, No. N7387, No. N7387, Jul. 29, 2005, 140 pages.
(Continued)

*Primary Examiner* — Michael N Opsasnick
(74) *Attorney, Agent, or Firm* — Fish & Richardson P.C.

(57) ABSTRACT

A method and apparatus for encoding and decoding an audio signal are provided. The present invention includes receiving an audio signal including an audio descriptor, recognizing that the audio signal includes a downmix signal and a spatial information signal using the audio descriptor, and converting the downmix signal to a multi-channel signal using the spatial information signal, wherein the spatial information signal includes a header each a preset temporal or spatial interval, and the spatial information signal includes a header each a preset temporal or spatial interval thereby the header can be selectively included in the spatial information signal and if the header is plurally included in the spatial information signal, it is able to decode spatial information in case of reproducing the audio signal from a random point.

5 Claims, 6 Drawing Sheets

U.S. PATENT DOCUMENTS

| | | | | |
|---|---|---|---|---|
| 4,661,862 | A | 4/1987 | Thompson | |
| 4,725,885 | A | 2/1988 | Gonzales et al. | |
| 4,907,081 | A | 3/1990 | Okamura et al. | |
| 5,243,686 | A | 9/1993 | Tokuda et al. | |
| 5,481,643 | A | 1/1996 | Ten Kate et al. | |
| 5,515,296 | A | 5/1996 | Agarwal | |
| 5,528,628 | A | 6/1996 | Park et al. | |
| 5,530,750 | A | 6/1996 | Akagiri | |
| 5,563,661 | A | 10/1996 | Takahashi et al. | |
| 5,579,430 | A | 11/1996 | Grill et al. | |
| 5,606,618 | A | 2/1997 | Lokhoff et al. | |
| 5,621,856 | A | 4/1997 | Akagiri | |
| 5,640,159 | A | 6/1997 | Furlan et al. | |
| 5,682,461 | A | 10/1997 | Silzle et al. | |
| 5,687,157 | A | 11/1997 | Imai et al. | |
| 5,890,125 | A | 3/1999 | Davis et al. | |
| 5,912,636 | A | 6/1999 | Gormish et al. | |
| 5,945,930 | A | 8/1999 | Kajiwara | |
| 5,946,352 | A * | 8/1999 | Rowlands et al. | 375/242 |
| 5,966,688 | A | 10/1999 | Nandkumar et al. | |
| 5,974,380 | A | 10/1999 | Smyth et al. | |
| 6,021,386 | A | 2/2000 | Davis et al. | |
| 6,122,619 | A * | 9/2000 | Kolluru et al. | 704/500 |
| 6,125,398 | A | 9/2000 | Mirashrafi et al. | |
| 6,128,597 | A * | 10/2000 | Kolluru et al. | 704/500 |
| 6,134,518 | A | 10/2000 | Cohen et al. | |
| 6,148,283 | A | 11/2000 | Das | |
| 6,208,276 | B1 | 3/2001 | Snyder | |
| 6,272,615 | B1 * | 8/2001 | Li et al. | 711/220 |
| 6,295,009 | B1 | 9/2001 | Goto | |
| 6,295,319 | B1 | 9/2001 | Sueyoshi et al. | |
| 6,309,424 | B1 | 10/2001 | Fallon | |
| 6,339,760 | B1 | 1/2002 | Koda et al. | |
| 6,384,759 | B2 | 5/2002 | Snyder | |
| 6,399,760 | B1 | 6/2002 | Gimeno et al. | |
| 6,421,467 | B1 | 7/2002 | Mitra | |
| 6,442,110 | B1 | 8/2002 | Yamamoto et al. | |
| 6,453,120 | B1 | 9/2002 | Takahashi et al. | |
| 6,456,966 | B1 | 9/2002 | Iwabuchi | |
| 6,556,685 | B1 | 4/2003 | Urry et al. | |
| 6,560,404 | B1 | 5/2003 | Okada et al. | |
| 6,611,212 | B1 | 8/2003 | Craven et al. | |
| 6,631,352 | B1 | 10/2003 | Fujita et al. | |
| 6,636,830 | B1 | 10/2003 | Princen et al. | |
| 6,903,664 | B2 | 6/2005 | Schröder et al. | |
| 7,266,501 | B2 * | 9/2007 | Saunders et al. | 704/500 |
| 7,376,555 | B2 | 5/2008 | Schuijers et al. | |
| 7,391,870 | B2 * | 6/2008 | Herre et al. | 381/23 |
| 7,394,903 | B2 * | 7/2008 | Herre et al. | 381/23 |
| 7,447,317 | B2 * | 11/2008 | Herre et al. | 381/23 |
| 7,519,538 | B2 | 4/2009 | Villemoes et al. | |
| 2001/0055302 | A1 | 12/2001 | Taylor et al. | |
| 2002/0049586 | A1 | 4/2002 | Nishio et al. | |
| 2002/0106019 | A1 | 8/2002 | Chaddha et al. | |
| 2003/0009325 | A1 | 1/2003 | Kirchherr et al. | |
| 2003/0016876 | A1 | 1/2003 | Chai et al. | |
| 2003/0138157 | A1 | 7/2003 | Schwartz | |
| 2003/0195742 | A1 | 10/2003 | Tsushima | |
| 2003/0236583 | A1 | 12/2003 | Baumgarte et al. | |
| 2004/0049379 | A1 | 3/2004 | Thumpudi et al. | |
| 2004/0057523 | A1 | 3/2004 | Koto et al. | |
| 2004/0138895 | A1 | 7/2004 | Lokhoff et al. | |
| 2004/0186735 | A1 | 9/2004 | Ferris et al. | |
| 2004/0199276 | A1 | 10/2004 | Poon | |
| 2004/0247035 | A1 | 12/2004 | Schroder et al. | |
| 2005/0058304 | A1 | 3/2005 | Baumgarte et al. | |
| 2005/0074127 | A1 | 4/2005 | Herre et al. | |
| 2005/0074135 | A1 | 4/2005 | Kushibe | |
| 2005/0091051 | A1 | 4/2005 | Moriya et al. | |
| 2005/0114126 | A1 | 5/2005 | Geiger et al. | |
| 2005/0137729 | A1 | 6/2005 | Sakurai et al. | |
| 2005/0157883 | A1 | 7/2005 | Herre et al. | |
| 2005/0174269 | A1 | 8/2005 | Sherigar et al. | |
| 2005/0216262 | A1 | 9/2005 | Fejzo | |
| 2006/0009225 | A1 | 1/2006 | Herre et al. | |
| 2006/0023577 | A1 | 2/2006 | Shinoda et al. | |
| 2006/0085200 | A1 | 4/2006 | Allamanche et al. | |
| 2006/0190247 | A1 | 8/2006 | Lindblom | |
| 2007/0038439 | A1 | 2/2007 | Schiujers et al. | |
| 2007/0150267 | A1 | 6/2007 | Honma et al. | |
| 2009/0185751 | A1 | 7/2009 | Kudo et al. | |
| 2009/0216543 | A1 | 8/2009 | Pang et al. | |

FOREIGN PATENT DOCUMENTS

| | | |
|---|---|---|
| CN | 1655651 | 8/2005 |
| DE | 69712383 | 1/2003 |
| EP | 372601 | 6/1990 |
| EP | 599825 | 6/1994 |
| EP | 0610975 | 8/1994 |
| EP | 827312 | 3/1998 |
| EP | 0943143 | 4/1999 |
| EP | 948141 | 10/1999 |
| EP | 957639 | 11/1999 |
| EP | 1001549 | 5/2000 |
| EP | 1047198 | 10/2000 |
| EP | 1376538 | 1/2004 |
| EP | 1396843 | 3/2004 |
| EP | 1869774 | 10/2006 |
| EP | 1905005 | 1/2007 |
| GB | 2238445 | 5/1991 |
| GB | 2340351 | 2/2002 |
| JP | 60-096079 | 5/1985 |
| JP | 62-094090 | 4/1987 |
| JP | 09-275544 | 10/1997 |
| JP | 11-205153 | 7/1999 |
| JP | 2001-188578 | 7/2001 |
| JP | 2001-53617 | 9/2002 |
| JP | 2002-328699 | 11/2002 |
| JP | 2002-335230 | 11/2002 |
| JP | 2003-005797 | 1/2003 |
| JP | 2003-233395 | 8/2003 |
| JP | 2004-170610 | 6/2004 |
| JP | 2004-175656 | 6/2004 |
| JP | 2004-220743 | 8/2004 |
| JP | 2004-271812 | 9/2004 |
| JP | 2005-063655 | 3/2005 |
| JP | 2005-332449 | 12/2005 |
| JP | 2005-352396 | 12/2005 |
| JP | 2006-120247 | 5/2006 |
| KR | 1997-0014387 | 3/1997 |
| KR | 2001-0001991 | 5/2001 |
| KR | 2003-0043620 | 6/2003 |
| KR | 2003-0043622 | 6/2003 |
| RU | 2158970 | 11/2000 |
| RU | 2214048 | 10/2003 |
| RU | 2221329 | 1/2004 |
| RU | 2005103637 | 7/2005 |
| TW | 204406 | 4/1993 |
| TW | 289885 | 11/1996 |
| TW | 317064 | 10/1997 |
| TW | 360860 | 6/1999 |
| TW | 378478 | 1/2000 |
| TW | 384618 | 3/2000 |
| TW | 405328 | 9/2000 |
| TW | 550541 | 9/2003 |
| TW | 567466 | 12/2003 |
| TW | 569550 | 1/2004 |
| TW | 200404222 | 3/2004 |
| TW | 1230530 | 4/2004 |
| TW | 200405673 | 4/2004 |
| TW | M257575 | 2/2005 |
| WO | WO 95/27337 | 10/1995 |
| WO | 97/40630 | 10/1997 |
| WO | 99/52326 | 10/1999 |
| WO | WO 99/56470 | 11/1999 |
| WO | 00/02357 | 1/2000 |
| WO | 00/60746 | 10/2000 |
| WO | WO 00/79520 | 12/2000 |
| WO | WO 03/046889 | 6/2003 |
| WO | 03/090028 | 10/2003 |
| WO | 03/090206 | 10/2003 |
| WO | 03/090207 | 10/2003 |
| WO | WO 03/088212 | 10/2003 |
| WO | 2004/008806 | 1/2004 |
| WO | 2004/028142 | 4/2004 |
| WO | WO2004072956 | 8/2004 |
| WO | 2004/080125 | 9/2004 |

| | | |
|---|---|---|
| WO | WO 2004/093495 | 10/2004 |
| WO | WO 2005/043511 | 5/2005 |
| WO | 2005/059899 | 6/2005 |
| WO | 2006/048226 | 5/2006 |
| WO | WO 2006/048226 | 5/2006 |
| WO | 2006/084916 | 8/2006 |
| WO | WO 2006/108464 | 10/2006 |

OTHER PUBLICATIONS

Deputy Chief of the Electrical and Radio Engineering Department Makhotna, S.V., Russian Decision on Grant Patent for Russian Patent Application No. 2008112226 dated Jun. 5, 2009, and its translation, 15 pages.
Extended European search report for European Patent Application No. 06799105.9 dated Apr. 28, 2009, 11 pages.
Supplementary European Search Report for European Patent Application No. 06799058 dated Jun. 16, 2009, 6 pages.
Supplementary European Search Report for European Patent Application No. 06757751 dated Jun. 8, 2009, 5 pages.
Herre, J. et al., "Overview of MPEG-4 audio and its applications in mobile communication", Communication Technology Proceedings, 2000. WCC—ICCT 2000. International Confrence on Beijing, China held Aug. 21-25, 2000, Piscataway, NJ, USA, IEEE, US, vol. 1 (Aug. 21, 2008), pp. 604-613.
Oh, H-O et al., "Proposed core experiment on pilot-based coding of spatial parameters for MPEG surround", ISO/IEC JTC 1/SC 29/WG 11, No. M12549, Oct. 13, 2005, 18 pages XP030041219.
Pang, H-S, "Clipping Prevention Scheme for MPEG Surround", ETRI Journal, vol. 30, No. 4 (Aug. 1, 2008), pp. 606-608.
Quackenbush, S. R. et al., "Noiseless coding of quantized spectral components in MPEG-2 Advanced Audio Coding", Application of Signal Processing to Audio and Acoustics, 1997. 1997 IEEE ASSP Workshop on New Paltz, NY, US held on Oct. 19-22, 1997, New York, NY, US, IEEE, US, (Oct. 19, 1997), 4 pages.
Russian Decision on Grant Patent for Russian Patent Application No. 2008103314 dated Apr. 27, 2009, and its translation, 11 pages.
USPTO Non-Final Office Action in U.S. Appl. No. 12/088,868, mailed Apr. 1, 2009, 11 pages.
USPTO Non-Final Office Action in U.S. Appl. No. 12/088,872, mailed Apr. 7, 2009, 9 pages.
USPTO Non-Final Office Action in U.S. Appl. No. 12/089,383, mailed Jun. 25, 2009, 5 pages.
USPTO Non-Final Office Action in U.S. Appl. No. 11/540,920, mailed Jun. 2, 2009, 8 pages.
USPTO Non-Final Office Action in U.S. Appl. No. 12/089,105, mailed Apr. 20, 2009, 5 pages.
USPTO Non-Final Office Action in U.S. Appl. No. 12/089,093, mailed Jun. 16, 2009, 10 pages.
Notice of Allowance issued in corresponding Korean Application Serial No. 2008-7007453, dated Feb. 27, 2009 (no English translation available).
Canadian Office Action for Application No. 2613885 dated Mar. 16, 2010, 1 page.
Notice of Allowance dated Sep. 25, 2009 issued in U.S. Appl. No. 11/540,920.
Office Action dated Jul. 14 2009 issued in Taiwan Application No. 095136561.
Notice of Allowance dated Apr. 13, 2009 issued in Taiwan Application No. 095136566.
Bosi, M., et al. "ISO/IEC MPEG-2 Advanced Audio Coding." *Journal of the Audio Engineering Society* 45.10 (Oct. 1, 1997): 789-812. XP000730161.
Ehrer, A., et al. "Audio Coding Technology of ExAC." *Proceedings of 2004 International Symposium on Hong Kong*, China Oct. 20, 2004, Piscataway, New Jersey. IEEE, 290-293. XP010801441.
European Search Report & Written Opinion for Application No. EP 06799113.3, dated Jul. 20, 2009, 10 pages.
European Search Report & Written Opinion for Application No. EP 06799111.7 dated Jul. 10, 2009, 12 pages.
European Search Report & Written Opinion for Application No. EP 06799107.5, dated Aug. 24, 2009, 6 pages.
European Search Report & Written Opinion for Application No. EP 06799108.3, dated Aug. 24, 2009, 7 pages.
International Preliminary Report on Patentability for Application No. PCT/KR2006/004332, dated Jan. 25, 2007, 3 pages.
Korean Intellectual Property Office Notice of Allowance for No. 10-2008-7005993, dated Jan. 13, 2009, 3 pages.
Russian Notice of Allowance for Application No. 2008112174, dated Sep. 11, 2009, 13 pages.
Schuller, Gerald D.T., et al. "Perceptual Audio Coding Using Adaptive Pre- and Post-Filters and Lossless Compression." *IEEE Transactions on Speech and Audio Processing* New York, 10.6 (Sep. 1, 2002): 379. XP011079662.
Taiwan Examiner, Taiwanese Office Action for Application No. 095124113, dated Jul. 21, 2008, 13 pages.
Taiwanese Notice of Allowance for Application No. 95124070, dated Sep. 18, 2008, 7 pages.
Taiwanese Notice of Allowance for Application No. 95124112, dated Jul. 20, 2009, 5 pages.
Tewfik, A.H., et al. "Enhance wavelet based audio coder." *IEEE*. (1993): 896-900. XP010096271.
USPTO Non-Final Office Action in U.S. Appl. No. 11/514,302, mailed Sep. 9, 2009, 24 pages.
USPTO Notice of Allowance in U.S. Appl. No. 12/089,098, mailed Sep. 8, 2009, 19 pages.
Bessette B, et al.: Universal Speech/Audio Coding Using Hybrid ACELP/TCX Techniques, 2005, 4 pages.
Boltze Th. et al.; "Audio services and applications." In: Digital Audio Broadcasting. Edited by Hoeg, W. and Lauferback, Th. ISBN 0-470-85013-2. John Wiley & Sons Ltd., 2003. pp. 75-83.
Breebaart, J., AES Convention Paper 'MPEG Spatial audio coding/MPEG surround: Overview and Current Status', 119th Convention, Oct. 7-10, 2005, New York, New York, 17 pages.
Chou, J. et al.: Audio Data Hiding with Application to Surround Sound, 2003, 4 pages.
Faller C., et al.: Binaural Cue Coding—Part II: Schemes and Applications, 2003, 12 pages, IEEE Transactions on Speech and Audio Processing, vol. 11, No. 6.
Faller C.: Parametric Coding of Spatial Audio. Doctoral thesis No. 3062, 2004, 6 pages.
Faller, C: "Coding of Spatial Audio Compatible with Different Playback Formats", Audio Engineering Society Convention Paper, 2004, 12 pages, San Francisco, CA.
Hamdy K.N., et al.: Low Bit Rate High Quality Audio Coding with Combined Harmonic and Wavelet Representations, 1996, 4 pages.
Heping, D.,: Wideband Audio Over Narrowband Low-Resolution Media, 2004, 4 pages.
Herre, J. et al.: MP3 Surround: Efficient and Compatible Coding of Multi-channel Audio, 2004, 14 pages.
Herre, J. et al: The Reference Model Architecture for MPEG Spatial Audio Coding, 2005, 13 pages, Audio Engineering Society Convention Paper.
Hosoi S., et al.: Audio Coding Using the Best Level Wavelet Packet Transform and Auditory Masking, 1998, 4 pages.
International Search Report corresponding to International Application No. PCT/KR2006/002018 dated Oct. 16, 2006, 1 page.
International Search Report corresponding to International Application No. PCT/KR2006/002019 dated Oct. 16, 2006, 1 page.
International Search Report corresponding to International Application No. PCT/KR2006/002020 dated Oct. 16, 2006, 2 pages.
International Search Report corresponding to International Application No. PCT/KR2006/002021 dated Oct. 16, 2006, 1 page.
International Search Report corresponding to International Application No. PCT/KR2006/002575, dated Jan. 12, 2007, 2 pages.
International Search Report corresponding to International Application No. PCT/KR2006/002578, dated Jan. 12, 2007, 2 pages.
International Search Report corresponding to International Application No. PCT/KR2006/002579, dated Nov. 24, 2006, 1 page.
International Search Report corresponding to International Application No. PCT/KR2006/002581, dated Nov. 24, 2006, 2 pages.
International Search Report corresponding to International Application No. PCT/KR2006/002583, dated Nov. 24, 2006, 2 pages.
International Search Report corresponding to International Application No. PCT/KR2006/003420, dated Jan. 18, 2007, 2 pages.

International Search Report corresponding to International Application No. PCT/KR2006/003424, dated Jan. 31, 2007, 2 pages.
International Search Report corresponding to International Application No. PCT/KR2006/003426, dated Jan. 18, 2007, 2 pages.
International Search Report corresponding to International Application No. PCT/KR2006/003435, dated Dec. 13, 2006, 1 page.
International Search Report corresponding to International Application No. PCT/KR2006/003975, dated Mar. 13, 2007, 2 pages.
International Search Report corresponding to International Application No. PCT/KR2006/004014, dated Jan. 24, 2007, 1 page.
International Search Report corresponding to International Application No. PCT/KR2006/004017, dated Jan. 24, 2007, 1 page.
International Search Report corresponding to International Application No. PCT/KR2006/004020, dated Jan. 24, 2007, 1 page.
International Search Report corresponding to International Application No. PCT/KR2006/004024, dated Jan. 29, 2007, 1 page.
International Search Report corresponding to International Application No. PCT/KR2006/004025, dated Jan. 29, 2007, 1 page.
International Search Report corresponding to International Application No. PCT/KR2006/004027, dated Jan. 29, 2007, 1 page.
International Search Report corresponding to International Application No. PCT/KR2006/004032, dated Jan. 24, 2007, 1 page.
International Search Report in corresponding International Application No. PCT/KR2006/004023, dated Jan. 23, 2007, 1 page.
ISO/IEC 13818-2, Generic Coding of Moving Pictures and Associated Audio, Nov. 1993, Seoul, Korea.
ISO/IEC 14496-3 Information Technology—Coding of Audio-Visual Objects—Part 3: Audio, Second Edition (ISO/IEC), 2001.
Jibra A., et al.: Multi-layer Scalable LPC Audio Format; ISACS 2000, 4 pages, IEEE International Symposium on Circuits and Systems.
Jin C, et al.: Individualization in Spatial-Audio Coding, 2003, 4 pages, IEEE Workshop on Applications of Signal Processing to Audio and Acoustics.
Kostantinides K: An introduction to Super Audio CD and DVD-Audio, 2003, 12 pages, IEEE Signal Processing Magazine.
Liebchem, T.; Reznik, Y.A.: MPEG-4: an Emerging Standard for Lossless Audio Coding, 2004, 10 pages, Proceedings of the Data Compression Conference.
Ming, L.: A novel random access approach for MPEG-1 multicast applications, 2001, 5 pages.
Moon, Han-gil, et al.: A Multi-Channel Audio Compression Method with Virtual Source Location Information for MPEG-4 SAC, IEEE 2005, 7 pages.
Moriya T., et al.,: A Design of Lossless Compression for High-Quality Audio Signals, 2004, 4 pages.
Notice of Allowance dated Aug. 25, 2008 by the Korean Patent Office for counterpart Korean Appln. Nos. 2008-7005851, 7005852; and 7005858.
Notice of Allowance dated Dec. 26, 2008 by the Korean Patent Office for counterpart Korean Appln. Nos. 2008-7005836, 7005838, 7005839, and 7005840.
Notice of Allowance dated Jan. 13, 2009 by the Korean Patent Office for a counterpart Korean Appln. No. 2008-7005992.
Office Action dated Jul. 21, 2008 issued by the Taiwan Patent Office, 16 pages.
Oh, E., et al.: Proposed changes in MPEG-4 BSAC multi channel audio coding, 2004, 7 pages, International Organisation for Standardisation.
Pang, H., et al., "Extended Pilot-Based Codling for Lossless Bit Rate Reduction of MPEG Surround", ETRI Journal, vol. 29, No. 1, Feb. 2007.
Puri, A., et al.: MPEG-4: An object-based multimedia coding standard supporting mobile applications, 1998, 28 pages, Baltzer Science Publishers BV.
Said, A.: On the Reduction of Entropy Coding Complexity via Symbol Grouping: I—Redundancy Analysis and Optimal Alphabet Partition, 2004, 42 pages, Hewlett-Packard Company.
Schroeder E F et al: DER MPEG-2STANDARD: Generische Codierung fur Bewegtbilder and zugehorige Audio-Information, 1994, 5 pages.
Schuijers, E. et al: Low Complexity Parametric Stereo Coding, 2004, 6 pages, Audio Engineering Society Convention Paper 6073.
Stoll, G.: MPEG Audio Layer II: A Generic Coding Standard for Two and Multichannel Sound for DVB, DAB and Computer Multimedia, 1995, 9 pages, International Broadcasting Convention, XP006528918.
Supplementary European Search Report corresponding to Application No. EP06747465, dated Oct. 10, 2008, 8 pages.
Supplementary European Search Report corresponding to Application No. EP06747467, dated Oct. 10, 2008, 8 pages.
Supplementary European Search Report corresponding to Application No. EP06757755, dated Aug. 1, 2008, 1 page.
Supplementary European Search Report corresponding to Application No. EP06843795, dated Aug. 7, 2008, 1 page.
Ten Kate W. R. Th., et al.: A New Surround-Stereo-Surround Coding Technique, 1992, 8 pages, J. Audio Engineering Society, XP002498277.
Voros P.: High-quality Sound Coding within 2×64 kbit/s Using Instantaneous Dynamic Bit-Allocation, 1988, 4 pages.
Webb J., et al.: Video and Audio Coding for Mobile Applications, 2002, 8 pages, The Application of Programmable DSPs in Mobile Communications.
Office Action, Japanese Appln. No. 2008-519181, dated Nov. 30, 2010, 11 pages with English translation.
Herre, J. et al., "The Reference Model Architecture for MPEG Spatial Audio Coding," Convention Paper of the Audio Engineering Society 118th Convention, *Convention Paper 6447*, May 28, 2005, pp. 1-13.
Office Action, U.S. Appl. No. 11/994,404, mailed Aug. 31, 2011, 6 pages.

* cited by examiner

METHOD AND APPARATUS FOR DECODING AN AUDIO SIGNAL AND IDENTIFYING INFORMATION INCLUDED IN THE AUDIO SIGNAL

TECHNICAL FIELD

The present invention relates to an audio signal processing, and more particularly, to an apparatus for encoding and decoding an audio signal and method thereof.

BACKGROUND ART

Generally, an audio signal encoding apparatus compresses an audio signal into a mono or stereo type downmix signal instead of compressing each channels of a multi-channel audio signal. The audio signal encoding apparatus transfers the compressed downmix signal to a decoding apparatus together with a spatial information signal (or, ancillary data signal) or stores the compressed downmix signal and the spatial information signal in a storage medium.

In this case, the spatial information signal, which is extracted in downmixing a multi-channel audio signal, is used in restoring an original multi-channel audio signal from a compressed downmix signal.

The spatial information signal includes a header and spatial information. And, configuration information is included in the header. The header is the information for interpreting the spatial information.

An audio signal decoding apparatus decodes the spatial information using the configuration information included in the header. The configuration information, which is included in the header, is transferred to a decoding apparatus or stored in a storage medium together with the spatial information.

An audio signal encoding apparatus multiplexes an encoded downmix signal and the spatial information signal together into a bitstream form and then transfers the multiplexed signal to a decoding apparatus. Since configuration information is invariable in general, a header including configuration information is inserted in a bitstream once. Since configuration information is transmitted with being initially inserted in an audio signal once, an audio signal decoding apparatus has a problem in decoding spatial information due to non-existence of configuration information in case of reproducing the audio signal from a random timing point. Namely, since an audio signal is reproduced from a specific timing point requested by a user instead of being reproduced from an initial part in case of a broadcast, VOD (video on demand) or the like, it is unable to use configuration information transferred by being included in an audio signal. So, it may be unable to decode spatial information.

DISCLOSURE OF THE INVENTION

An object of the present invention is to provide a method and apparatus for encoding and decoding an audio signal which enables the audio signal to be decoded by making header selectively included in a frame in the spatial information signal.

Another object of the present invention is to provide a method and apparatus for encoding and decoding an audio signal which enables the audio signal to be decoded even if the audio signal is reproduced from a random point by the audio signal decoding apparatus by making a plurality of headers included in a spatial information signal.

To achieve these and other advantages and in accordance with the purpose of the present invention, as embodied and broadly described, a method of decoding an audio signal according to the present invention includes receiving an audio signal including an audio descriptor, recognizing that the audio signal includes a downmix signal and a spatial information signal using the audio descriptor, and converting the downmix signal to a multi-channel signal using the spatial information signal, wherein the spatial information signal includes a header each a preset temporal or spatial interval.

BEST MODE FOR CARRYING OUT THE INVENTION

Reference will now be made in detail to the preferred embodiments of the present invention, examples of which are illustrated in the accompanying drawings.

For understanding of the present invention, an apparatus and method of encoding an audio signal is explained prior to an apparatus and method of decoding an audio signal. Yet, the decoding apparatus and method according to the present invention are not limited to the following encoding apparatus and method. And, the present invention is applicable to an audio coding scheme for generating a multi-channel using spatial information as well as MP3 (MPEG 1/2-layer III) and AAC (advanced audio coding).

Figure 1:
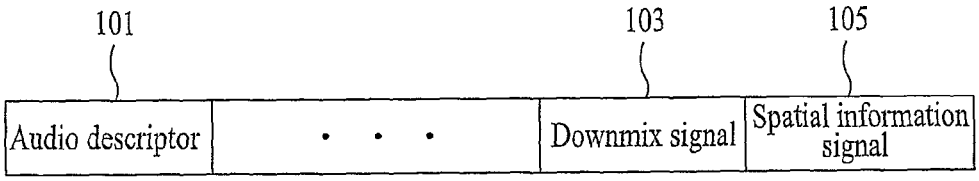
FIG. 1 is a configurational diagram of an audio signal according to one embodiment of the present invention.

FIG. 1 is a configurational diagram of an audio signal transferred to an audio signal decoding apparatus from an audio signal encoding apparatus according to one embodiment of the present invention.

Referring to FIG. 1, an audio signal includes an audio descriptor 101, a downmix signal 103 and a spatial information signal 105.

In case of using a coding scheme for reproducing an audio signal for broadcasting or the like, the audio signal may include ancillary data as well as the audio descriptor 101 and the downmix signal 103. The present invention may include the spatial information signal 105 as ancillary data. In order for an audio signal decoding apparatus to know basic information of audio codec without analyzing an audio signal, the audio signal may selectively include the audio descriptor 101. The audio descriptor 101 is comprised of small number of basic informations necessary for audio decoding such as a transmission rate of a transmitted audio signal, a number of channels, a sampling frequency of compressed data, an identifier indicating a currently used codec and the like.

An audio signal decoding apparatus is able to know a type of a codec used by an audio signal using the audio descriptor 101. In particular, using the audio descriptor 101, the audio signal decoding apparatus is able to know whether a received audio signal is the signal restoring a multi-channel using the spatial information signal 105 and the downmix signal 103. In this case, the multi-channel may include a virtual 3-dimensional surround as well as an actual multi-channel. By the virtual 3-dimensional surround technology, an audio signal having the spatial information signal 105 and the downmix signal 103 combined together is made audible through one or two channels.

The audio descriptor 101 is located independent from the downmix or the spatial information signal 103 or 105 included in the audio signal. For instance, the audio descriptor 101 is located within a separate field indicating an audio signal.

In case that a header is not provided to the downmix signal 103, the audio signal decoding apparatus is able to decode the downmix signal 103 using the audio descriptor 101.

The downmix signal 103 is a signal generated from downmixing a multi-channel. The downmix signal 103 can be generated from a downmixing unit (not shown in the drawing) included in an audio signal encoding apparatus (not shown in the drawing) or generated artificially.

The downmix signal 103 can be categorized into a case of including the spatial information signal 105 and a case of not including the header.

In case that the downmix signal 103 includes the header, the header is included in each frame by a frame unit. In case that the downmix signal 103 does not include the header, as mentioned in the foregoing description, the downmix signal 103 can be decoded using the audio descriptor 101 by an audio signal decoding apparatus. The downmix signal 103 takes either a form of including the header for each frame or a form of not including the header. And, the downmix signal 103 is included in an audio signal in a same manner until contents end.

The spatial information signal 105 is also categorized into a case of including the header and spatial information and a case of including the spatial information only without including the header. The header of the spatial information signal 105 differs from that of the downmix signal 103 in that it is unnecessary to be inserted in each frame identically. In particular, the spatial information signal 105 is able to use a frame including the header and a frame not including the header together. Most of information included in the header of the spatial information signal 105 is configuration information that decodes the spatial information by interpreting the spatial information.

Figure 2:
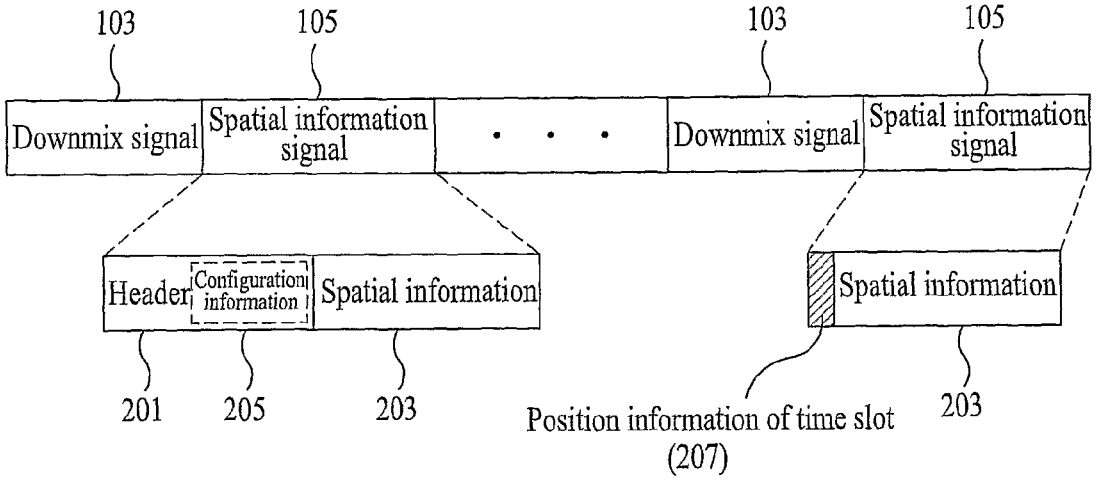
FIG. 2 is a configurational diagram of an audio signal according to another embodiment of the present invention.

FIG. 2 is a configurational diagram of an audio signal transferred to an audio signal decoding apparatus from an audio signal encoding apparatus according to another embodiment of the present invention.

Referring to FIG. 2, an audio signal includes the downmix signal 103 and the spatial information signal 105. And, the audio signal exists in an ES (elementary stream) form that frames are arranged.

Each of the downmix signal 103 and the spatial information signal 105 is occasionally transferred as a separate ES form to an audio signal decoding apparatus. And the downmix signal 103 and the spatial information signal 105, as shown in FIG. 2, can be combined into one ES form to be transferred to the audio signal decoding apparatus.

In case that the downmix signal 103 and the spatial information signal 105, which are combined into one ES form, are transferred to the audio signal decoding apparatus, the spatial information signal 105 can be included in a position of ancillary data (ancillary data) or additional data (extension data) of the downmix signal 103.

And, the audio signal may include signal identification information indicating whether the spatial information signal 105 is combined with the downmix signal 103.

A frame of the spatial information signal 105 can be categorized into a case of including the header 201 and the spatial information 203 and a case of including the spatial information 203 only. In particular, the spatial information signal 105 is able to use a frame including the header 201 and a frame not including the header 201 together.

In the present invention, the header 201 is inserted in the spatial information signal 105 at least once. In particular, an audio signal encoding apparatus may insert the header 201 into each frame in the spatial information signal 105, periodically insert the header 201 into each fixed interval of frames in the spatial information signal 105 or non-periodically insert the header 201 into each random interval of frames in the spatial information signal 105.

The audio signal may include information (hereinafter named 'header identification information') indicating whether the header 201 is included in a frame 201.

In case that the header 201 is included in the spatial information signal 105, the audio signal decoding apparatus extracts the configuration information 205 from the header 201 and then decodes the spatial information 203 transferred after (behind) the header 201 according to the configuration information 205. Since the header 201 is information for decoding by interpreting the spatial information 203, the header 201 is transferred in the early stage of transferring the audio signal.

In case that the header 201 is not included in the spatial information signal 105, the audio signal decoding apparatus decodes the spatial information 203 using the header 201 transferred in the early stage.

In case that the header 201 is lost while the audio signal is transferred to the audio signal decoding apparatus from the audio signal encoding apparatus or in case that the audio signal transferred in a streaming format is decoded from its middle part to be used for broadcasting or the like, it is unable to use the header 201 that was previously transferred. In this case, the audio signal decoding apparatus extracts the configuration information 205 from the header 201 different from the former header 201 firstly inserted in the audio signal and is then able to decode the audio signal using the extracted configuration information 205. In this case, the configuration information 205 extracted from the header 201 inserted in the audio signal may be identical to the former configuration information 205 extracted from the header 201 which had been transferred in the early stage or may not.

If the header 201 is variable, the configuration information 205 is extracted from a new header 201, the extracted configuration information 205 is decoded and the spatial information 203 transmitted behind the header 201 is then decoded. If the header 201 is invariable, it is decided whether the new header 201 is identical to the old header 201 that was previously transferred. If theses two headers 201 are different from each other, it can be detected that an error occurs in an audio signal on an audio signal transfer path.

The configuration information 205 extracted from the header 201 of the spatial information signal 105 is the information to interpret the spatial information 203.

The spatial information signal 105 is able to include information (hereinafter named 'time align information') for discriminating a time delay difference between two signals in generating a multi-channel using the downmix signal 103 and the spatial information signal 105 by the audio signal decoding apparatus.

An audio signal transferred to the audio signal decoding apparatus from the audio signal encoding apparatus is parsed by a demultiplexing unit (not shown in the drawing) and is then separated into the downmix signal 103 and the spatial information signal 105.

The downmix signal 103 separated by the demultiplexing unit is decoded. A decoded downmix signal 103 generates a multi-channel using the spatial information signal 105. In generating the multi-channel by combining the downmix signal 103 and the spatial information signal 105, the audio signal decoding apparatus is able to adjust synchronization between two signals, a position of a start point of combining two signals and the like using the time align information (not shown in the drawing) included in the configuration information 205 extracted from the header 201 of the spatial information signal 105.

Position information 207 of a time slot to which a parameter will be applied is included in the spatial information 203 included in the spatial information signal 105. As a spatial parameter (spatial cue), there is CLDs (channel level differences) indicating an energy difference between audio signals, ICCs (interchannel correlations) indicating closeness or similarity between audio signals, CPCs (channel prediction coefficients) indicating a coefficient predicting an audio signal value using other signals. Hereinafter, each spatial cue or a bundle of spatial cues will be called 'parameter'.

In case N parameters exist in a frame included in the spatial information signal 105, the N parameters are applied to specific time slot positions of frames, respectively. If information indicating a parameter will be applied to which one of time slots included in a frame is named the position information 207 of the time slot, the audio signal decoding apparatus decodes the spatial information 203 using the position information 207 of the time slot to which the parameter will be applied. In this case, the parameter is included in the spatial information 203.

Figure 3:
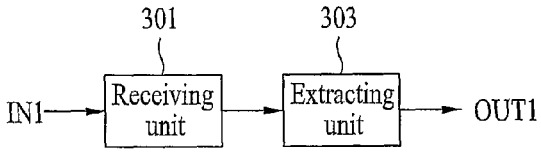
FIG. 3 is a block diagram of an apparatus for decoding an audio signal according to one embodiment of the present invention.

FIG. 3 is a schematic block diagram of an apparatus for decoding an audio signal according to one embodiment of the present invention.

Referring to FIG. 3, an apparatus for decoding an audio signal according to one embodiment of the present invention includes a receiving unit 301 and an extracting unit 303.

The receiving unit 301 of the audio signal decoding apparatus receives an audio signal transferred in an ES form by an audio signal encoding apparatus via an input terminal IN1.

The audio signal received by the audio signal decoding apparatus includes an audio descriptor 101 and the downmix signal 103 and may further include the spatial information signal 105 as ancillary data (ancillary data) or additional data (extension data).

The extracting unit 303 of the audio signal decoding apparatus extracts the configuration information 205 from the header 201 included in the received audio signal and then outputs the extracted configuration information 205 via an output terminal OUT1.

The audio signal may include the header identification information for identifying whether the header 201 is included in a frame.

The audio signal decoding apparatus identifies whether the header 201 is included in the frame using the header identification information included in the audio signal. If the header 201 is included, the audio signal decoding apparatus extracts the configuration information 205 from the header 201. In the present invention, at least one header 201 is included in the spatial information signal 105.

Figure 4:
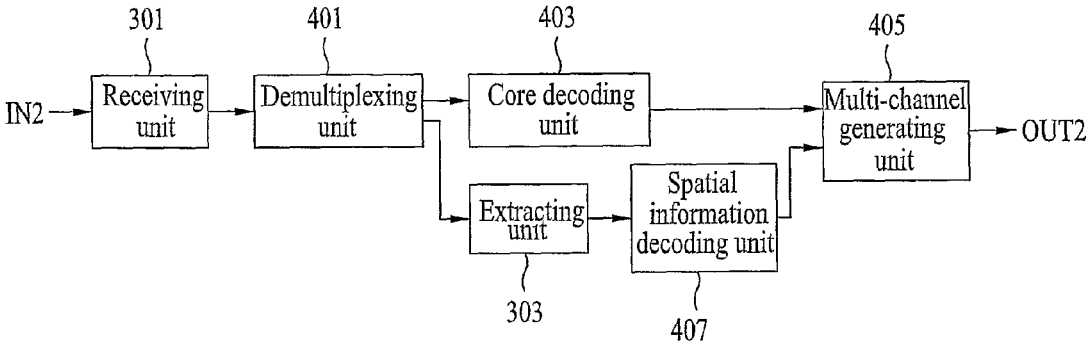
FIG. 4 is a block diagram of an apparatus for decoding an audio signal according to another embodiment of the present invention.

FIG. 4 is a block diagram of an apparatus for decoding an audio signal according to another embodiment of the present invention.

Referring to FIG. 4, an apparatus for decoding an audio signal according to another embodiment of the present invention includes the receiving unit 301, the demultiplexing unit 401, a core decoding unit 403, a multi-channel generating unit 405, a spatial information decoding unit 407 and the extracting unit 303.

The receiving unit 301 of the audio signal decoding apparatus receives an audio signal transferred in a bitstream form from an audio signal encoding apparatus via an input terminal IN2. And, the receiving unit 301 sends the received audio signal to the demultiplexing unit 401.

The demultiplexing unit 401 separates the audio signal sent by the receiving unit 301 into an encoded downmix signal 103 and an encoded spatial information signal 105. The demultiplexing unit 401 transfers the encoded downmix signal 103 separated from a bitstream to the core decoding unit 403 and transfers the encoded spatial information signal 105 separated from the bitstream to the extracting unit 303.

The encoded downmix signal 103 is decoded by the core decoding unit 403 and is then transferred to the multi-channel generating unit 405. The encoded spatial information signal 105 includes the header 201 and the spatial information 203.

If the header 201 is included in the encoded spatial information signal 105, the extracting unit 303 extracts the configuration information 205 from the header 201. The extracting unit 303 is able to discriminate a presence of the header 201 using the header identification information included in the audio signal. In particular, the header identification information may represent whether the header 201 is included in a frame included in the spatial information signal 105. The header identification information may indicate an order of a frame or a bit sequence of the audio signal, in which the configuration information 205 extracted from the header 201 is included if the header 201 is included in the frame.

In case of deciding that the header 201 is included in the frame via the header identification information, the extracting unit 303 extracts the configuration information 205 from the header 201 included in the frame. The extracted configuration information 205 is then decoded.

The spatial information decoding unit 407 decodes the spatial information 203 included in the frame according to decoded configuration information 205.

And, the multi-channel generating unit 405 generates a multi-channel signal using the decoded downmix signal 103 and decoded spatial information 203 and then outputs the generated multi-channel signal via an output terminal OUT2.

Figure 5:
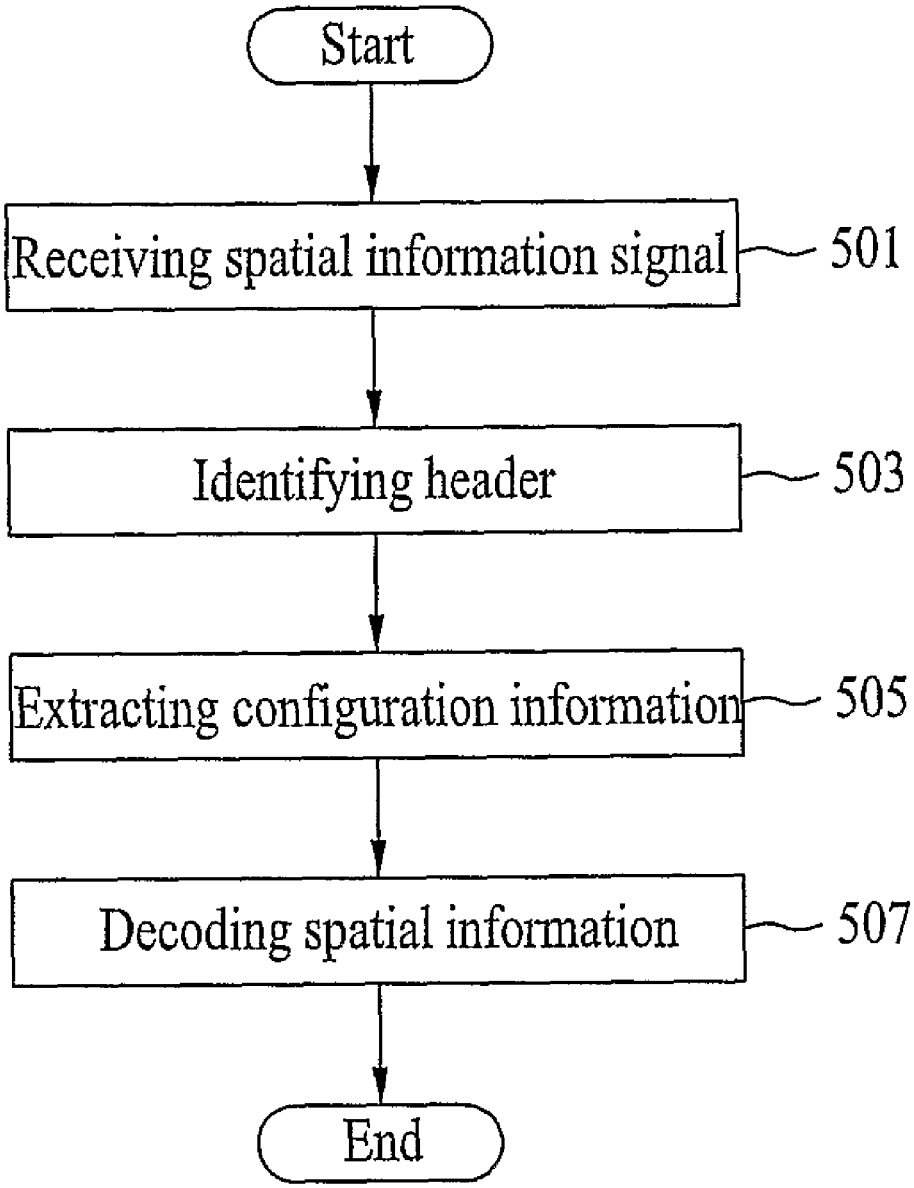
FIG. 5 is a flowchart of a method of decoding an audio signal according to one embodiment of the present invention.

FIG. 5 is a flowchart of a method of decoding an audio signal according to one embodiment of the present invention.

Referring to FIG. 5, an audio signal decoding apparatus receives the spatial information signal 105 transferred in a bitstream form by an audio signal encoding apparatus (S501).

As mentioned in the foregoing description, the spatial information signal 105 can be categorized into a case of being transferred as an ES separated from the downmix signal 103 and a case of being transferred by being combined with the downmix signal 103.

The demultiplexing unit 401 of an audio signal separates the received audio signal into the encoded downmix signal 103 and the encoded spatial information signal 105. The encoded spatial information signal 105 includes the header 201 and the spatial information 203. If the header 201 is included in a frame of the spatial information signal 105, the audio signal decoding apparatus identifies the header 201 (S503).

The audio signal decoding apparatus extracts the configuration information 205 from the header 201 (S505).

And, the audio signal decoding apparatus decodes the spatial information 203 using the extracted configuration information 205 (S507).

Figure 6:
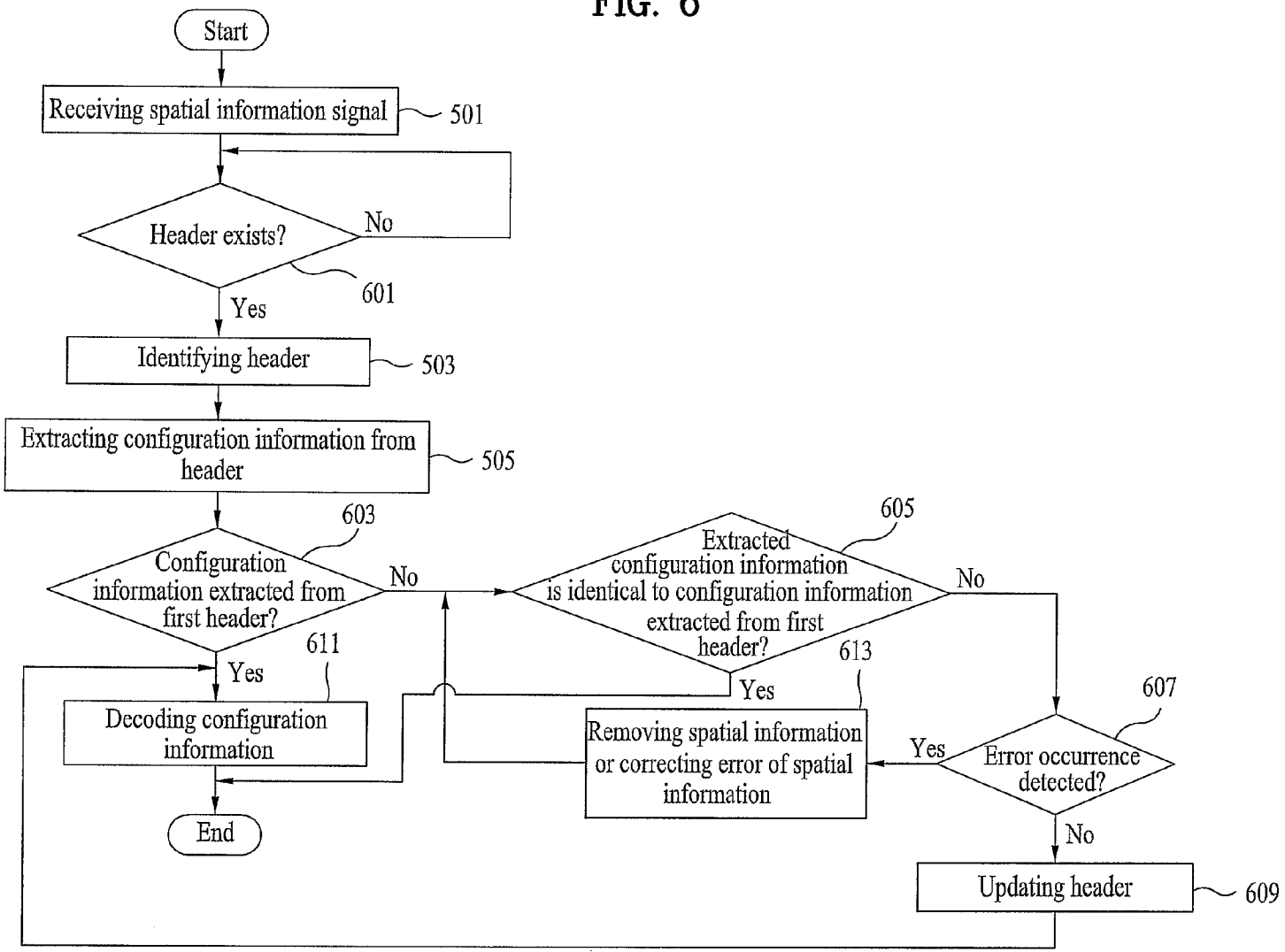
FIG. 6 is a flowchart of a method of decoding an audio signal according to another embodiment of the present invention.

FIG. 6 is a flowchart of a method of decoding an audio signal according to another embodiment of the present invention.

Referring to FIG. 6, an audio signal decoding apparatus receives the spatial information signal 105 transferred in a bitstream form by an audio signal encoding apparatus (S501).

As mentioned in the foregoing description, the spatial information signal 105 can be categorized into a case of being transferred as an ES separated from the downmix signal 103 and a case of being transferred by being included in ancillary data or extension data of the downmix signal 103.

The demultiplexing unit 401 of an audio signal separates the received audio signal into the encoded downmix signal 103 and the encoded spatial information signal 105. The encoded spatial information signal 105 includes the header 201 and the spatial information 203. The audio signal decoding apparatus decides whether the header 201 is included in a frame (S601).

If the header 201 is included in the frame, the audio signal decoding apparatus identifies the header 201 (S503).

The audio signal decoding apparatus then extracts the configuration information 205 from the header 201 (S505).

The audio signal decoding apparatus decides whether the configuration information 205 extracted from the header 201 is the configuration information 205 extracted from a first header 201 included in the spatial information signal 105 (S603).

If the configuration information 205 is extracted from the header 201 extracted first from the audio signal, the audio signal decoding apparatus decodes the configuration information 205 (S611) and decodes the spatial information 203 transferred behind the configuration information 205 according to the decoded configuration information 205.

If the header 201 extracted from the audio signal is not the header 201 extracted first from the spatial information signal 105, the audio signal decoding apparatus decides whether the configuration information 205 extracted from the header 201 is identical to the configuration information 205 extracted from the first header 201 (S605).

If the configuration information 205 is identical to the configuration information 205 extracted from the first header 201, the audio signal decoding apparatus decodes the spatial information 203 using the decoded configuration information 205 extracted from the first header 201.

If the extracted configuration information 205 is not identical to the configuration information 205 extracted from the first header 201, the audio signal decoding apparatus decides whether an error occurs in the audio signal on a transfer path from the audio signal encoding apparatus to the audio signal decoding apparatus (S607).

If the configuration information 205 is variable, the error does not occur even if the configuration information 205 is not identical to the configuration information 205 extracted from the first header 201. Hence, the audio signal decoding apparatus updates the header 201 into the new header 201 (S609). The audio signal decoding apparatus then decodes the configuration information 205 extracted from the updated header 201 (S611).

The audio signal decoding apparatus decodes the spatial information 203 transferred behind the configuration information 205 according to the decoded configuration information 205.

If the configuration information 205, which is invariable, is not identical to the configuration information 205 extracted from the first header 201, it means that the error occurs on the audio signal transfer path. Hence, the audio signal decoding apparatus removes the spatial information 203 included in the frame including the erroneous configuration information 205 or corrects the error of the spatial information 203 (S613).

Figure 7:
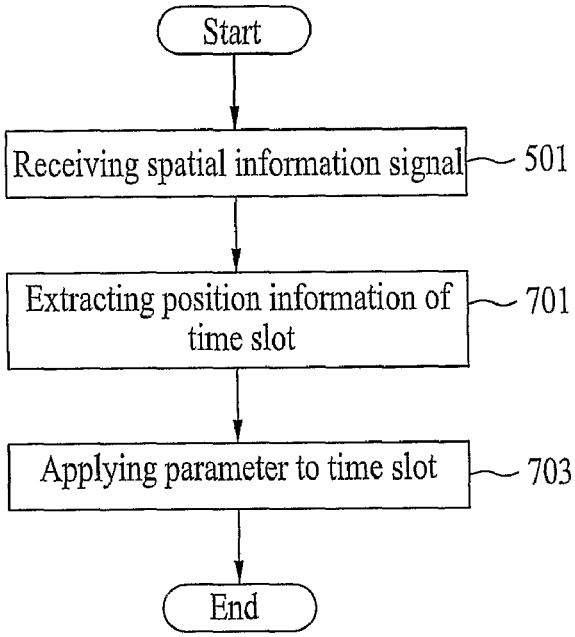
FIG. 7 is a flowchart of a method of decoding an audio signal according to a further embodiment of the present invention.

FIG. 7 is a flowchart of a method of decoding an audio signal according to a further embodiment of the present invention.

Referring to FIG. 7, an audio signal decoding apparatus receives the spatial information signal 105 transferred in a bitstream form by an audio signal encoding apparatus (S501).

The demultiplexing unit 401 of an audio signal separates the received audio signal into the encoded downmix signal 103 and the encoded spatial information signal 105. In this case, the position information 207 of the time slot to which a parameter will be applied is included in the spatial information signal 105.

The audio signal decoding apparatus extracts the position information 207 of the time slot from the spatial information 203 (S701).

The audio signal decoding apparatus applies a parameter to the corresponding time slot by adjusting a position of the time slot, to which the parameter will be applied, using the extracted position information of the time slot (S703).

Figure 8:
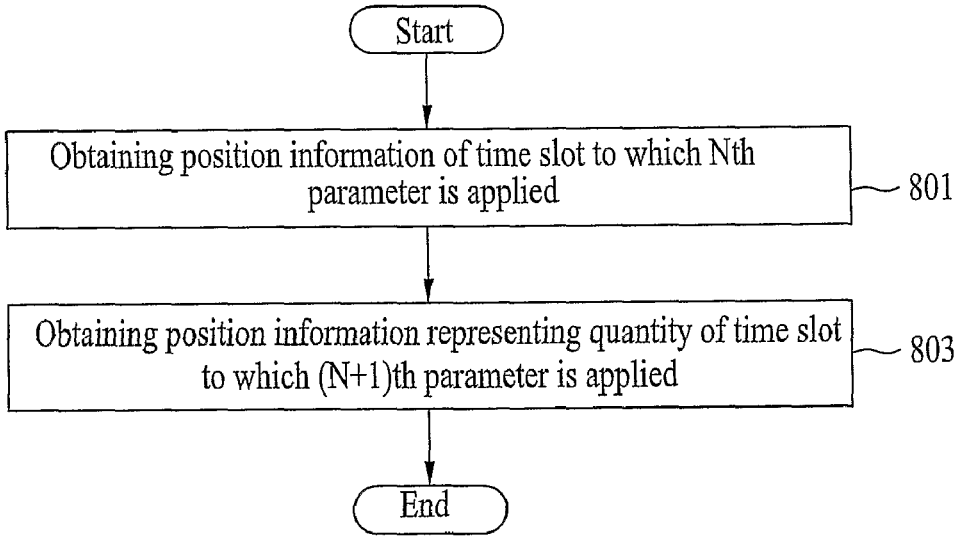
FIG. 8 is a flowchart of a method of obtaining a position information representing quantity according to one embodiment of the present invention.

FIG. 8 is a flowchart of a method of obtaining a position information representing quantity according to one embodiment of the present invention. A position information representing quantity of a time slot is the number of bits allocated to represent the position information 207 of the time slot.

The position information representing quantity of the time slot, to which a first parameter is applied, can be found by subtracting the number of parameters from the number of time slots, adding 1 to the subtraction result, taking a 2-base logarithm on the added value and applying a ceil function to the logarithm value. In particular, the position information representing quantity of the time slot, to which the first parameter will be applied, can be found by $\mathrm{ceil}(\log_2(k-i+1))$, where 'k' and 'i' are the number of time slots and the number of parameters, respectively.

Assuming that 'N' is a natural number, the position information representing quantity of the time slot, to which an $(N+1)^{th}$ parameter will be applied, is represented as the position information 207 of the time slot to which an $N^{th}$ parameter is applied. In this case, the position information 207 of the time slot, to which an $N^{th}$ parameter is applied, can be found by adding the number of time slots existing between the time slot to which the $N^{th}$ parameter is applied and a time slot to which an $(N-1)^{th}$ parameter is applied to the position information of the time slot to which the $(N-1)^{th}$ parameter is applied and adding 1 to the added value (S801). In particular, the position information of the time slot to which the $(N+1)^{th}$ parameter will be applied can be found by $j(N)+r(N+1)+1$, where $r(N+1)$ indicates the number of time slots existing between the time slot to which the $(N+1)^{th}$ parameter is applied and the time slot to which the $N^{th}$ parameter is applied.

If the position information 207 of the time slot to which the $N^{th}$ parameter is applied is found, the time slot position information representing quantity representing the position of the time slot to which the $(N+1)^{th}$ parameter is applied can be obtained. In particular, the time slot position information representing quantity representing the position of the time slot to which the $(N+1)^{th}$ parameter is applied can be found by subtracting the number of parameters applied to a frame and the position information of the time slot to which the $N^{th}$ parameter is applied from the number of time slots and adding (N+1) to the subtraction value (S803). In particular, the position information representing quantity of the time slot to which the $(N+1)^{th}$ parameter is applied can be found by ceil $(\log_2(k-i+N+1-j(N)))$, where 'k', 'i' and 'j(N)' are the number of time slots, the number of parameters and the position information 205 of the time slot to which an $N^{th}$ parameter is applied, respectively.

In case of obtaining the position information representing quantity of the time slot in the above-explained manner, the position information representing quantity of the time slot to which the $(N+1)^{th}$ parameter is applied has the number of allocated bits inverse-proportional to 'N'. Namely, the position information representing quantity of the time slot to which the parameter is applied is a variable value depending on 'N'.

Figure 9:
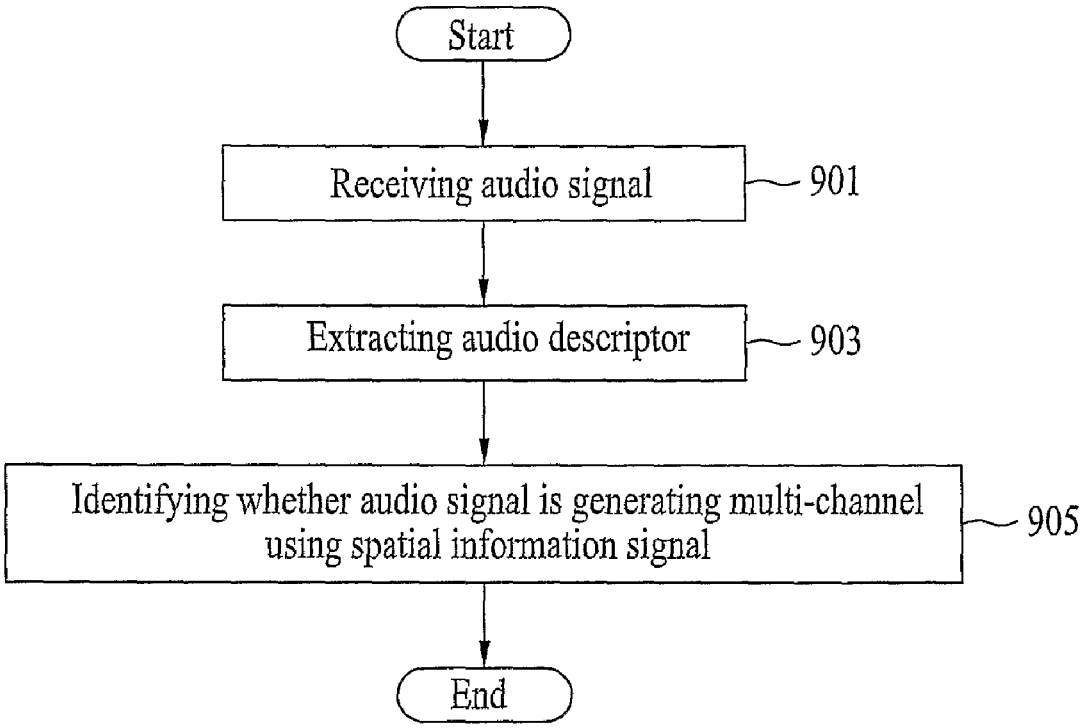
FIG. 9 is a flowchart of a method of decoding an audio signal according to another further embodiment of the present invention.

FIG. 9 is a flowchart of a method of decoding an audio signal according to further embodiment of the present invention.

An audio signal decoding apparatus receives an audio signal from an audio signal encoding apparatus (S901). The audio signal includes the audio descriptor 101, the downmix signal 103 and the spatial information signal 105.

The audio signal decoding apparatus extracts the audio descriptor 101 included in the audio signal (S903). An identifier indicating an audio codec is included in the audio descriptor 101.

The audio signal decoding apparatus recognizes that the audio signal includes the downmix signal 103 and the spatial information signal 105 using the audio descriptor 101. In particular, the audio signal decoding apparatus is able to discriminate that the transferred audio signal is a signal for generating a multi-channel, using the spatial information signal 105(S905).

And, the audio signal decoding apparatus converts the downmix signal 103 to a multi-channel signal using the spatial information signal 105. As mentioned in the foregoing description, the header 201 can be included in the spatial information signal 105 each predetermined interval.

Industrial Applicability

As mentioned in the foregoing description, a method and apparatus for encoding and decoding an audio signal according to the present invention can make a header selectively included in a spatial information signal.

And, in case that a plurality of headers are included in the spatial information signal, a method and apparatus for encoding and decoding an audio signal according to the present invention can decode spatial information even if the audio signal is reproduced from a random point by the audio signal decoding apparatus.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A method of decoding an audio signal, comprising:

receiving an audio signal including a downmix signal and ancillary data;

obtaining header identification information that indicates whether a frame of the ancillary data has a corresponding header or not;

when the header identification information indicates that the frame of the ancillary data has the corresponding header, extracting time align information from the corresponding header, and identifying a temporal relationship between the ancillary data and the downmix signal as indicated by the time align information.

2. The method of claim 1, wherein the time align information indicates a time delay between the ancillary data and the downmix signal when the ancillary data are embedded in the downmix signal.

3. The method of claim 1, wherein the ancillary data include at least one header in each a preset temporal or spatial interval.

4. The method of claim 3, further comprising:

determining whether a currently transported header and a previously transported header is the same header when the ancillary data include two or more headers; and if the currently transported header is different from the previously transported header based on the determining step, detecting that an error occurs in the header.

5. An apparatus of decoding an audio signal, comprising:

a receiving unit configured to perform operations comprising:

receiving an audio signal including a downmix signal and ancillary data; and an ancillary data decoding unit configured to perform operations comprising:

obtaining header identification information that indicates whether a frame of the ancillary data has a corresponding header or not; and when the obtained header identification information indicates that the frame of the ancillary data has the corresponding header, identifying time align information from the corresponding header that identifies a temporal relationship between the ancillary data and the downmix signal.

* * * * *

UNITED STATES PATENT AND TRADEMARK OFFICE

CERTIFICATE OF CORRECTION

PATENT NO. : 8,214,221 B2
APPLICATION NO. : 11/994407
DATED : July 3, 2012
INVENTOR(S) : Pang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1035 days.

Signed and Sealed this
Sixth Day of November, 2012

David J. Kappos

David J. Kappos
*Director of the United States Patent and Trademark Office*